United States Patent [19]

Koehler

[11] Patent Number: 4,604,599

[45] Date of Patent: Aug. 5, 1986

[54] ELECTROMAGNET COMPRISED OF YOKES AND AN ARMATURE SUPPORTING A PERMANENT MAGNET FITTED ON ITS POLE FACES WITH POLE PIECES THAT PROJECT FROM THE AXIS OF THE MAGNET, THIS AXIS BEING PERPENDICULAR TO THE DIRECTION OF MOVEMENT

[75] Inventor: Gérard Koehler, Ville d'Avray, France

[73] Assignee: La Telemecanique Electrique, Nanterre, France

[21] Appl. No.: 668,164

[22] Filed: Nov. 1, 1984

[30] Foreign Application Priority Data

Nov. 16, 1983 [FR] France ..... 83 18184

[51] Int. Cl.[4] ..... H01F 7/08

[52] U.S. Cl. ..... 335/230; 335/234

[58] Field of Search ..... 335/78, 79, 81, 229, 335/230, 234

[56] References Cited

U.S. PATENT DOCUMENTS 2,794,158 5/1957 Hoppe ..... 335/230 X

FOREIGN PATENT DOCUMENTS 36109 4/1981 Japan ..... 335/230

WO82/03944 4/1982 PCT Int'l Appl. .

806455 12/1958 United Kingdom ..... 335/230

*Primary Examiner*—George Harris

*Attorney, Agent, or Firm*—Young & Thompson

[57] ABSTRACT

The electromagnet comprises the yokes (31, 32*a*) which are moveable in relation to an armature (21*a*) and a winding (25) surrounding a part of the magnetic circuit, this armature (21*a*) comprised of a magnet (22*a*) fitted with two pole pieces (23*a*, 24*a*) projecting past both extremities of this magnet, at least one of the said pole pieces having its extremities bent at right angles in order to define the air gap inducing counter forces following a direction perpendicular to the axis of the permanent magnet (22*a*).

A second armature (21*b*) identical to the first (21*a*) is located parallel to and facing the first. Two yokes (31; 32*a*, 32*b*) join the air gap zones of the two armatures located facing each other in such a way that the magnetic circuit constitutes a sequence of armature and yoke forming a rectangle. Two windings (25, 28) are located on opposite sides of the above-mentioned rectangle.

Application primarily in the construction of electromagnets of low inertia, small volume and low leakage flux.

10 Claims, 5 Drawing Figures

Figure 1:
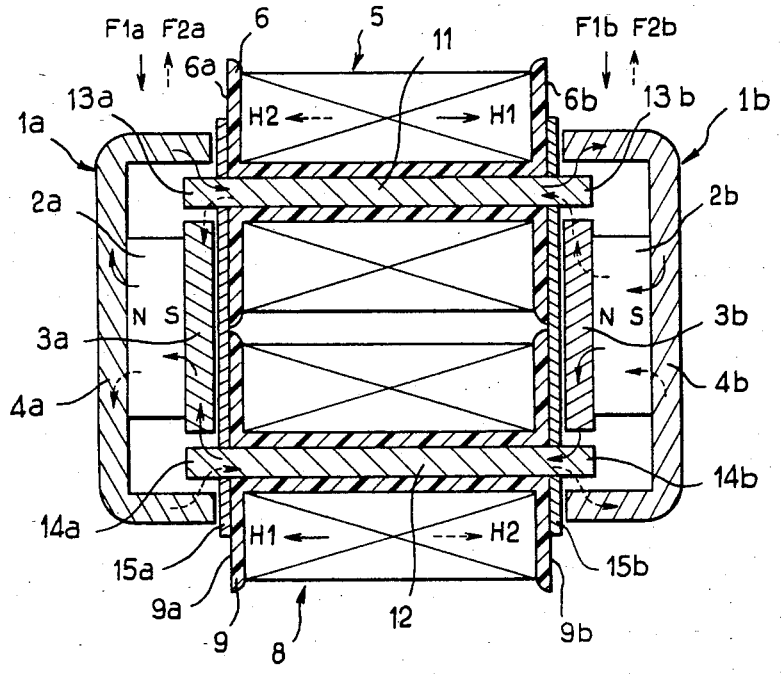

ELECTROMAGNET COMPRISED OF YOKES AND AN ARMATURE SUPPORTING A PERMANENT MAGNET FITTED ON ITS POLE FACES WITH POLE PIECES THAT PROJECT FROM THE AXIS OF THE MAGNET, THIS AXIS BEING PERPENDICULAR TO THE DIRECTION OF MOVEMENT

This invention relates to an electromagnet comprised of yokes and an armature supporting a permanent magnet fitted on its pole faces with pole pieces that project from the axis of the magnet, the relative movement of the armature with respect to the yokes having a direction perpendicular to the axis of the permanent magnet of the armature.

From French Pat. No. 2 358 006, an electromagnet is known whose structure corresponds to the above-mentioned definition, with at least one of the pole pieces of the armature having bent extremities.

French Pat. No. 2 466 844 of the applicant describes an electromagnet modified in relation to that described in French Pat. No. 2 358 006, in that the armature is placed within the winding.

French Pat. No. 2 520 152 and European Pat. No. 0 086 121 of the applicant describe electromagnets improved compared to the one described in French Pat. No. 2 466 844 to allow the electromagnet to function in a monostable manner, with the possibility of changing the moveable and fixed components.

On the other hand, from German Pat. No. 2 407 184 and French Pat. No. 2 486 303 an electromagnet is known that has two windings located side by side and its four extremities are joined in pairs by two armatures to form an H. However, in contrast to the electromagnets previously used, these armatures do not move in a translatory motion, but rather in a rotary motion.

The electromagnet described in French Pat. No. 2 388 386 also comprises two windings located side by side and its four extremities are joined in pairs by two armatures. These armatures move in a translatory motion along the axis of the magnet.

Also, from international patent application No. PCT WO 82/03 944 an electromagnet is known that is modified like the one described in French Pat. No. 2 358 006, in that its fixed and moveable parts are reversed and that a second assembly consisting of a magnet and pole pieces is added in a symmetrical fashion and is similarly mounted after the above-mentioned reversal has been made.

The electromagnet described in French Pat. No. 2 520 152 has the disadvantage of causing losses of flux by the leakage flux between the armature and the yoke. These flux losses may be demonstrated by means of a magnetic tracing obtained by CAO[1], when the electromagnet is excited and just starting to move.

[1] Translator's Note: Unknown abbreviation.

Also, the yokes of this electromagnet being bent, their extremities must be absolutely parallel and precisely arranged to obtain the simultaneous closing of the air gaps, and this necessitates taking elaborate precautions during manufacture.

On the other hand, in certain instances, the mass of the armature can fail to give an electromagnet adequate resistance against shock and inertia, a mode of operating which is important particularly when the electromagnet is used to control the opening of a limiting circuit breaker for short-circuit current.

In addition, when replacing an existing conventional electromagnet that has a limited travel, the physical limitations of the structure often cause installation problems.

Moreover, the windings of these electromagnets cannot be easily removed for maintenance purposes or to change the nominal voltage of the electromagnet.

The object of this invention is to overcome the disadvantages of conventional electromagnets.

The electromagnet envisaged by this invention consists of yokes and an armature, moveable in relation to each other, and a winding surrounding a section of the magnetic circuit, the said armature bearing a permanent magnet fitted on its two pole faces with two pole pieces projecting beyond the axis of this permanent magnet on both extremities, at least one of these said pole pieces having its extremities bent in order to form two air gap zones with the other pole piece, within which the extremities of the yokes penetrate in such a way that each air gap zone consists of two air gaps inducing counter forces along a direction perpendicular to the axis of the permanent magnet.

According to the invention, this electromagnet is characterized by having a second armature similarly shaped to the first one arranged in parallel opposite the first, and by having the two yokes that join together the air gap zones of the two armatures located facing each other, in such a way that the magnetic circuit is formed by a sequence of armature and yoke.

This arrangement allows the construction of direct and short connections that considerably reduce magnetic flux losses between the air gap zones that face each other.

According to an embodiment of the invention, the sequence of armature and yoke forms at least one rectangle and two windings are arranged on the opposite sides of the said rectangle.

Thus, the electromagnet, when in motion, occupies a space equal to that of an electromagnet that is fitted with only one winding.

According to another embodiment, two magnetic circuits in the shape of a rectangle are coupled to form a common branch around which a winding is arranged. According to a characteristic of this embodiment, the electromagnet is axially symmetrical along the direction of displacement. According to another characteristic of the preceding embodiments, the armatures are curved in such a fashion that the rectangular path of the flux becomes a circular path.

According to a particular embodiment of the invention, a permanent magnet is interposed between the extremities of at least one of the yokes so as to obtain a monostable functioning.

The addition of this magnet permits a monostable operation for the electromagnet to be obtained in a simple manner as a result.

Other characteristics and advantages of the invention will become apparent from the description below.

Figure 2:
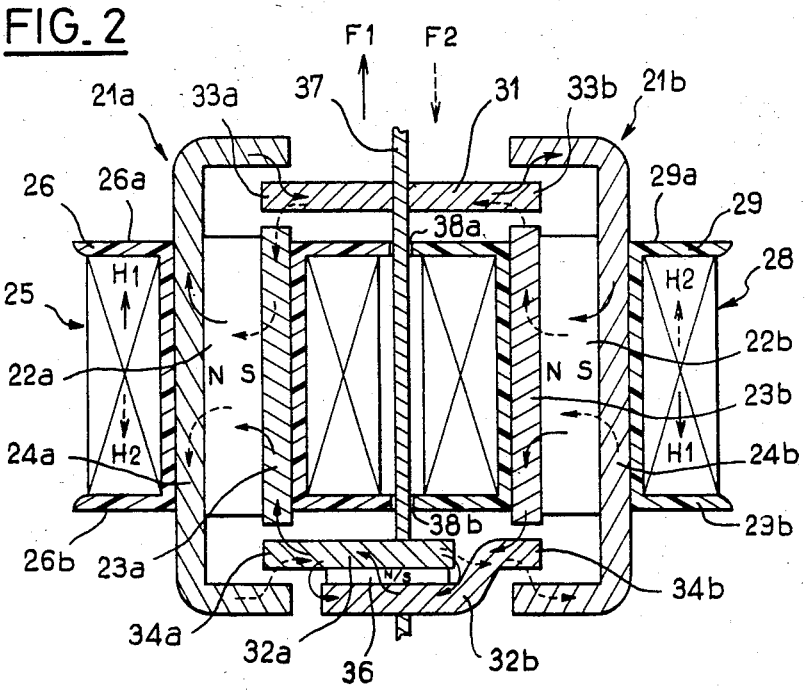
Figure 3:
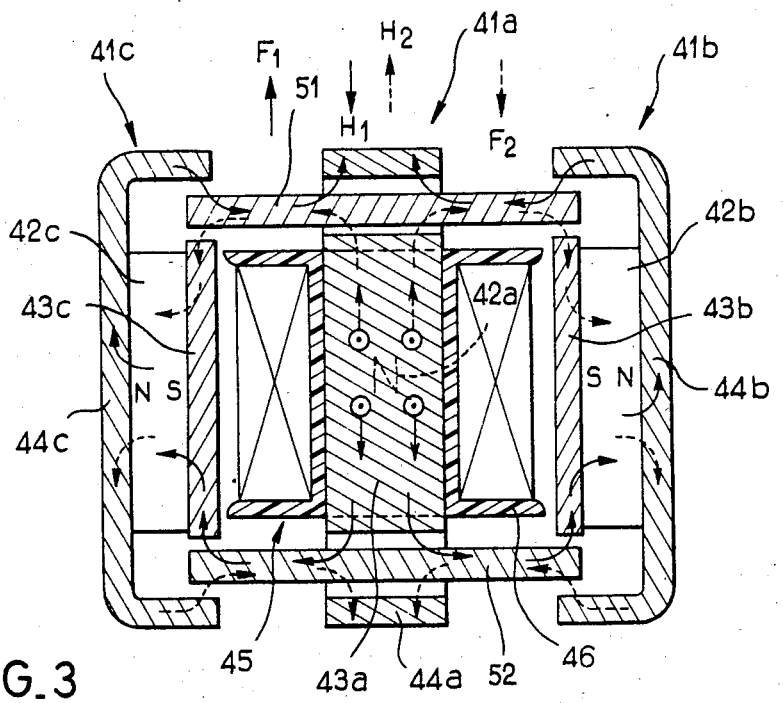
Figure 4:
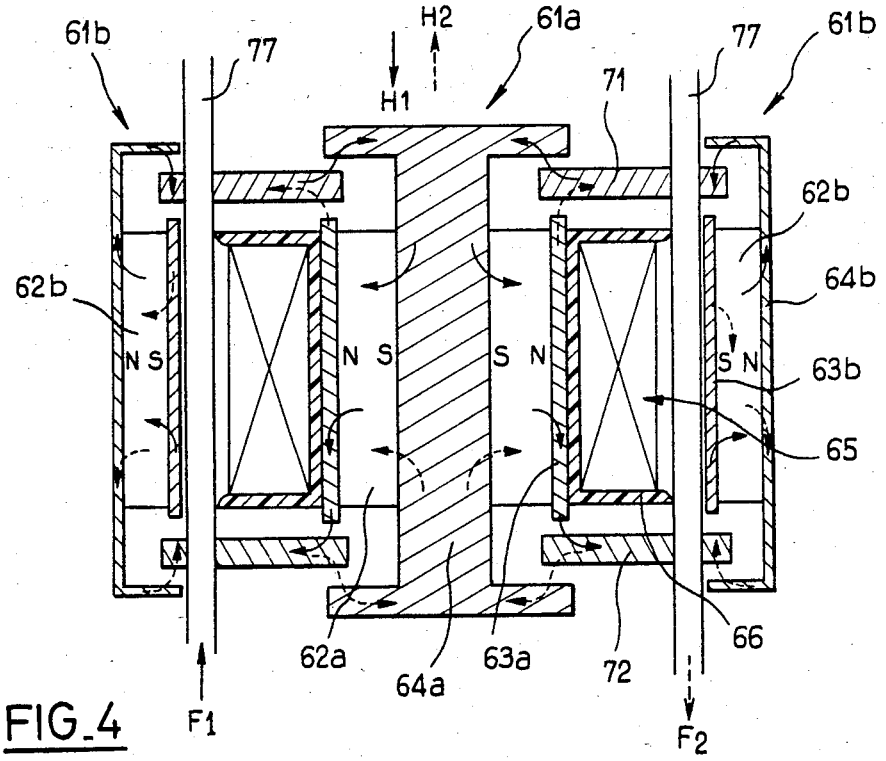
Figure 5:
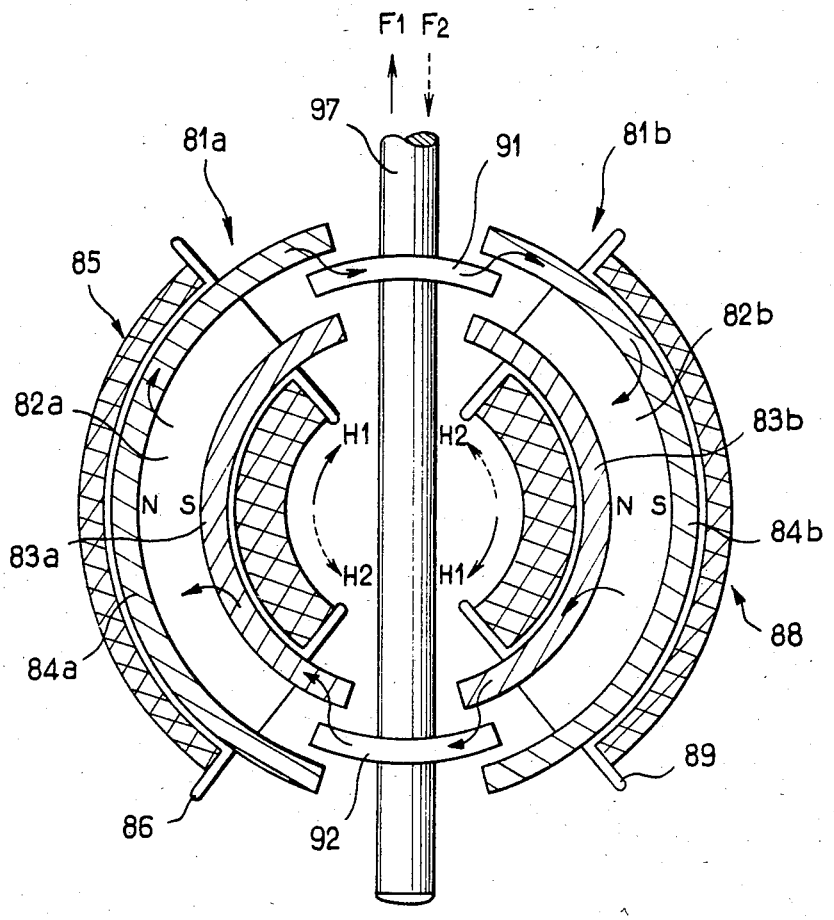

In the attached drawings as non-exclusive examples,

FIG. 1 is a longitudinal section of a first version of an electromagnet in accordance with the invention, FIG. 2 is a longitudinal section of a second version of an electromagnet in accordance with the invention, FIG. 3 is a longitudinal section of a third version of an electromagnet in accordance with the invention, FIG. 4 is a section of a fourth version; and FIG. 5 is that of a fifth version.

In the embodiment of FIG. 1, the electromagnet which is bistable in operation is comprised of the fixed yokes 11, 12, a moveable assembly comprised of an armature 1*a*, in section shaped essentially like an H and moveable in relation to the yokes 11, 12 and of a winding 5 surrounding a part of the magnetic circuit.

Armature 1*a* is made up of an permament magnet 2*a*, fitted on its two pole faces with two pole pieces 3*a*, 4*a*, which project beyond both ends of the axis of the magnet 2*a*.

One of the pole pieces 4*a* is bent at its extremities in relation to the axis of the magnet 2*a*, so as to define two air gap zones with the other pole piece 3*a*, within which the extremities 13*a*, 14*a* of the yokes 11, 12 penetrate. In this way each air gap zone is made up of two air gaps inducing counter forces $F_{1a}$, $F_{2a}$, along a direction perpendicular to the axis of the permanent magnet 2*a*.

The right angle bend of the extremities of the pole piece 4*a* allows the presence of parallel forces for the two air gap zones.

In FIG. 1 it may be seen that the moveable assembly also includes a second armature 1*b* composed of corresponding components 2*b*, 3*b*, 4*b*. This armature 1*b* is of the same shape as the first 1*a* and is arranged in parallel to and facing this first one. Furthermore, the extremities 13*a*, 13*b*; 14*a*, 14*b* of the two yokes 11, 12 join the air gap zones of the two armatures 1*a*, 1*b* which are located facing each other.

Thus, the magnetic circuit of the electromagnet is constituted of a sequence of armature and yoke forming a rectangle.

Also, a second winding 8 is arranged parallel to the first winding 5.

In the embodiment represented by FIG. 1, the windings 5, 8 are arranged respectively around the yokes 11, 12 which form two opposing sides of the above-mentioned rectangle defined by the magnetic circuit.

Furthermore, windings 5, 8 is each made up of a frame 6, 9 of plastic material that may be moulded around the yokes 11, 12 which function as the core for the corresponding windings 5, 8.

On the lateral surfaces 6*a*, 6*b*; 9*a*, 9*b* of the frames 6, 9 of plastic material, plates 15*a*, 15*b* of non-magnetic metal or alloy, such as brass, are attached which are used to separate the right angled extremities of pole pieces 4*a*, 4*b* from the frames of the windings and to guide the displacement of the magnetic armatures 1*a*, 1*b* along the direction indicated by the arrows $F_{1a}$, $F_{2a}$; $F_{1b}$, $F_{2b}$, that is to say perpendicular to the axis of windings 5 and 8.

The functioning of the bistable electromagnet that has just been described is as follows:

when windings 5 and 8 are excited in direction $H_1$, forces $F_{1a}$, $F_{1b}$ are induced in the armatures 1*a* and 1*b* which displaces them to one of the stable positions (towards the bottom of FIG. 1).

Conversely, when windings 5 and 8 are excited in direction $H_2$ contrary to direction $H_1$, the reverse forces $F_{2a}$, $F_{2b}$ are induced in armatures 1*a* and 1*b* which displaces them towards the other stable position (towards the top of FIG. 1).

The path of the flux in the magnetic circuit of the electromagnet is represented by solid arrows when windings 5 and 8 are excited in direction $H_1$ and by dashed arrows when the windings are excited in direction $H_2$.

It can be observed that direct and short connections exist between the air gap zones that are opposite to each other. As a consequence, a much reduced leakage flux is obtained.

The path of the magnetic flux that follows the contours of a rectangle or a square approaches the ideal path induced in a torus. The path is followed in one direction or the other along the direction of excitation $H_1$ or $H_2$.

The magnetic potential in the windings and the permanent magnets have a regular distribution along the path of the flux.

It is also observed that the air gaps are located very close to windings 5 and 8.

On the other hand, the structure of the electromagnet allows for an exact placement in the centre of plates 15*a*, 15*b* of yokes 11, 12 which form the flat cores for windings 5 and 8. These plates 15*a*, 15*b* may be used as mountings for the electromagnet.

In a modified version, the size of the pole pieces 3*a* and 3*b* near the air gaps may be greater than that illustrated, in order to increase the area of these air gaps.

To the same end, the extremities of the pole pieces 3*a*, 3*b* may be bent like the extremities of pole pieces 4*a*, 4*b*.

Furthermore, the structure of the electromagnet permits easy removal of windings 5, 8 and facilitates coupling windings 5, 8 in parallel or in series, in order to reduce the current consumption.

Also when changing the polarity of a magnet like magnet 2*b*, motion in a contrary direction by the armatures is obtained.

As well, in this case when embodying a mechanical link between armatures 1*a*, 1*b*, the resistance of the electromagnet to shock is enhanced.

It should also have been possible to place the windings around armatures 1*a* and 1*b*, and possibly also windings 5, 8 around yokes 11 and 12.

In the embodiment according to FIG. 2, wherein the corresponding reference numbers have been increased by 20, the electromagnet as is the case in FIG. 1, comprises two fixed armatures 21*a*, 21*b* essentially shaped like an H arranged in parallel and facing each other.

Similarly, two moveable yokes 31 and 32*a*, 32*b* join the air gap zones located opposite each other, in such a way that the magnetic circuit consists of a sequence of armature and yoke forming a rectangle.

In addition, as is the case in FIG. 1, two windings 25, 28 are arranged on the opposite sides of the above-mentioned rectangle.

Also, each armature 21*a*, 21*b* consists of two pole pieces 23*a*, 24*a*; 23*b*, 24*b* projecting beyond both ends of a permanent magnet 22*a*, 22*b*.

Pole piece 24*a*, 24*b* has two extremities bent at right angles which define with the other pole piece 23*a*, 23*b* two air gap zones within which the opposite extremities 33*a*, 33*b*; 34*a*, 34*b* of the yokes 31; 32*a*, 32*b* penetrate.

The electromagnet illustrated in FIG. 2 differs mainly from the one in FIG. 1 by the fact that windings 25 and 28 are placed around the assembly of each armature 21*a*, 21*b* as for patent FR 2 466 844.

Also, as an example, one of the magnetic yokes is composed of two parts 32*a*, 32*b* between which is interposed a thin permanent magnet 36.

Extremity 34*b* of component 32*b* is bent in the shape of a bayonet to allow it to be located in the extension of component 32*a* which is completely flat. This extremity 34*b*, as well as the opposite extremity 34*a* of flat component 32*a*, penetrates into the lower air gap zones of armatures 21*a* and 21*b*.

The functioning of the electromagnet illustrated in FIG. 2 is similar to that of the embodiment according to FIG. 1.

However, permanent magnet 36 reinforces the magnetic flux flowing in the direction of the solid arrows and this causes the displacement of the yokes in direction $F_1$ and the contrary for the magnetic flux flowing in the opposite direction (dashed arrows which point to the displacement of the yokes in direction $F_2$).

Nevertheless, the flux may still drain off because of leakage reluctances between components 32*a* and 32*b* and the narrow width of permanent magnet 36 as compared to magnets 22*a* and 22*b*.

Thus, the electromagnet illustrated in FIG. 2 has a monostable functioning, the position of rest corresponding to the displacement of the yokes in direction $F_1$ and the working position corresponding to displacement in the direction $F_2$.

Of course, a permanent magnet identical to magnet 36 might be interposed symmetrically in the yoke 31 made up of two components like yoke 32*a*, 32*b*.

Yet, one can observe in FIG. 2 that the opposing flat surfaces 26*a*, 26*b*; 29*a*, 29*b* of the frames of plastic material of windings 25 and 28 are recessed in comparison to the opposing extremities of pole pieces 23*a* and 23*b* and that the guide formed by plate 37 joins the two yokes 31 and 32*a*, 32*b*.

This guide plate 37 may be fastened to an external device (not illustrated) to which the movement of the yoke assembly may be transmitted, the armatures 21*a*, 21*b* and windings 25, 28 being fixed in this instance.

Plate 37 could be made of brass, sliding in slots 38*a*, 38*b* which are housed between the adjacent edges of frames 26, 29 of plastic material of the windings 25 and 28.

This plate 37 may be inserted into an opening in the armature 31, or possess a slot enclosing the assembly composed of armature elements 32*a*, 32*b* and the permanent magnet 36.

Plate 37 may be replaced by two supports extending from both sides of windings 25 and 28.

Thus, in the embodiment illustrated in FIG. 2, yokes 31, 32*a*, 32*b* which are moveable have low inertia in relation to the two armatures 21*a*, 21*b* which are fixed and this is advantageous for the operating speed of the electromagnet.

This inertia may be further reduced, by shortening the length of yoke 31 and by bending one end of the pole pieces 23*a*, 23*b* towards the other, which at the same time increases the areas of the air gaps.

The frames 26 and 29 of windings 25 and 28 may thus easily be moulded on the armatures 21*a*, 21*b*, in conditions that allow for the precise placement of the air gaps.

The height restriction in the direction of movement of the electromagnet illustrated in FIG. 2 is small, given that windings 25 and 28 are located facing each other parallel to this movement.

Moreover, the guide allows for a minor misalignment of the yokes. Thus one obtains a complete closure of the air gaps even when the positioning of the pole pieces is not absolutely accurate.

In FIG. 3, where the reference numbers are identical to those of FIG. 2 but increased by 20, armature 41*a* has been pivoted by 90° along its axis and the section has been made near the pole piece 43*a*. Armature 41*b* has not been modified, but its winding has been deleted. On the other hand, an armature 41*c* which is symmetrical to 41*b* in relation to 41*a* has been added. The winding on 41*c* has also been deleted. The guides for the two yokes 51 and 52 have not been illustrated. The flux circulation is represented as before following field $H_1$–$H_2$ of winding 45.

Instead of having a flux circulation following a rectangle whose two opposite sides are fitted with windings, one observes that now there are two rectangles having one common side, on which a single winding is mounted. This symmetrical arrangement has the advantage of being compact.

One can also consider the fact that the sections illustrated in 41*b* and 41*c* originate from a single curved armature in an arc of a circle concentric to armature 41*a*, with a magnet 42 of magnetized rubber.

FIG. 4 illustrates such an arrangement, after 20 has been added to the previous corresponding reference numbers.

Armature 61*b* is curved 360° forming a pot-shaped electromagnet. To complete the symmetry of the circle, the central armature 61*a* also has a cylindrical shape and is composed of a fully cylindrical pole piece 64*a* fitted on its two extremities with broadenings used as right angle extremities.

Pole piece 64*a* is surrounded by an annular magnet 62*a* radially magnetized, itself surrounded by a hollow cylindrical pole piece 63*a*. Of course, the thicknesses of the pole pieces may gradually diminish as one moves away from the axis of the pot.

Yokes 71 and 72 are joined and guided by components 77 transmitting the movement of the electromagnet. They have an annular shape.

Instead of having a cylindrical arrangement along the axis of displacement $F_1$–$F_2$, one may also transform the arrangement of FIG. 2 to obtain a cylindrical arrangement following an axis perpendicular to displacement $F_1$–$F_2$, as in FIG. 5, after addition of 20 to the preceding corresponding reference numbers.

It can be observed that windings 85 and 88 are curved in arcs of a circle concentric to the centre of the electromagnet, the permanent magnets 82*a* and 82*b* having a radial magnetization whose axis of symmetry or principal axis is always perpendicular to the displacement $F_1$–$F_2$. The extremities of pole pieces 84*a* and 84*b* are no longer bent at a right angle, but the curve of these pieces, and thus that of pieces 83*a*, 83*b*; 91 and 92 still permits the presence of parallel forces for the different air gap zones. This arrangement requires more complex tooling than in the previous cases, but it permits having a circular magnetic flux path, thus having a length much shorter than for a rectangular or square path. In addition, the permanent magnets are still closer to the air gaps.

In the same manner, it is also possible to change the arrangement of FIG. 4 so that, on each side of the axis of the winding, the flux path on the plane of the figure will be circular, with a common central section. One thus has a path in the shape of a horizontal figure eight, that because of symmetry follows the axis of the winding, gives a volume in the shape of a torus whose interior is occupied by the winding. One thus arrives at a structure minimizing the flux paths in the iron and the current in the copper.

Of course, the invention is not restricted to the examples that have been described and one may make numerous modifications to them within the framework of the invention.

Thus, the yoke 32*a*, 32*b* of FIG. 2 may have arms bent at 90°, the magnet 36 in this case being placed between the arms, so that the placement of the air gaps does not depend on the thickness of magnet 36 and the bending of component 32*b*.

The air gaps described in the examples above are of the constant surface type and with variable spacing between the surfaces. Within the framework of the invention, it should be possible to obtain an air gap with variable surface and a constant surface spacing, for example in the case of the embodiment according to FIG. 1 by eliminating extremity 13*a* of yoke 11 to a little bit below the level of guide plate 15*a* and thus getting closer to the corresponding extremities of pole pieces 3*a* and 4*a*. Such air gaps are nevertheless less efficient than those described, taking into account friction and the risks of incomplete closing.

The structures described below may also be enhanced with the improvements described in the patent entitled "Bistable operating electromagnet, with permanent magnet," registered this same day by the applicant.

I claim:

1. An electromagnet comprising yokes (11, 12; 31, 32*a*; 51, 52; 71, 72; 91, 92), an armature (1*a*, 21*a*, 41*a*, 61*a*, 81*a*) moveable in relation to each other, and a winding (5, 25, 45, 65, 85) surrounding a portion of a magnetic circuit, said armature (1*a*, 21*a*, 41*a*, 61*a*, 81*a*) comprising a permanent magnet (2*a*, 22*a*, 42*a*, 62*a*, 82*a*) fitted on its two pole faces with two pole pieces (3*a*, 4*a*; 23*a*, 24*a*; 43*a*, 44*a*; 63*a*, 64*a*; 83*a*, 84*a*) projecting beyond both extremities of the axis of this permanent magnet, at least one (4*a*, 24*a*, 44*a*, 64*a*, 84*a*) of these said pole pieces having bent extremities to define with the other pole piece (3*a*, 23*a*, 43*a*, 63*a*, 83*a*) two air gap zones within which penetrate the extremities of the yokes (11, 12; 31, 32*a*; 51, 52; 71, 72; 91, 92) in such a way that each air gap zone is made up of two air gaps inducing counter forces along a direction perpendicular to the principal axis of the permanent magnet (2*a*, 22*a*, 42*a*, 62*a*, 82*a*), characterized by the fact that at least one second armature (1*b*, 21*b*, 41*b*, 61*b*, 81*b*) of the same shape as the first (1*a*, 11*a*, 61*a*, 81*a*) is arranged in parallel with and facing the first, and that two yokes (11, 12; 31, 32*a*, 32*b*; 51, 52; 71, 72; 91, 92) join the air gap zones of the two armatures located facing one another in such a way that the magnetic circuit will be formed by a sequence of armature and yoke.

2. An electromagnet according to claim 1 wherein the sequence of armature and yoke forming at least one rectangle and wherein the two windings (5, 8; 25, 28) are arranged on the opposite sides of the said rectangle.

3. An electromagnet according to claim 2, wherein the windings (25, 28) are arranged around the armatures (21*a*, 21*b*).

4. An electromagnet according to claim 3, wherein a permanent magnet (36) is interposed between the extremities (34*a*, 34*b*) of at least one of the yokes in a manner that will obtain a monostable functioning.

5. An electromagnet according to claim 3, wherein the yokes (31, 32*a*, 32*b*) are joined by a guide (37) free-moving in relation to the armatures (21*a*, 21*b*) and windings (25, 28), this guide being attached to an external device to which is transmitted the movement of the abovementioned yokes.

6. An electromagnet according to one of the claim 3, wherein the frames (26, 29) of the windings (25, 28) are of plastic material moulded on the respective armatures (21*a*, 21*b*).

7. An electromagnet according to claim 1 wherein it comprises two armatures (41*b*, 41*c*; 61*b*, 61*c*) arranged symmetrically on each end of the axis of a central armature (41*a*, 61*a*) and having magnetic polarities that are also symmetrical, in such a way that the magnetic circuit is formed by two rectangles having one common branch (41*a*, 61*a*).

8. An electromagnet according to claim 7 wherein only the central armature (41*a*, 61*a*) is fitted with a winding (45, 65).

9. An electromagnet according to claim 1 wherein a second armature (61*b*) is curved in an arc of a circle concentrically to the central armature (61*a*), and wherein the magnetic axis of this second armature is directed towards the central armature (61*a*) and wherein only this first armature (61*a*) is fitted with a coil (65) in such a way as to form a pot-type electromagnet.

10. An electromagnet according to claim 3 wherein the windings (85, 88) with their permanent magnets (82*a*, 82*b*) and their pole pieces (83*a*, 84*a*, 83*b*, 84*b*) as well as the yokes (91, 92) are curved in an arc of a circle concentric to the centre of the electromagnet, in such a way that the flux path has a circular form.

* * * * *